United States Patent [19]

Kopp et al.

[11] 4,451,133

[45] May 29, 1984

[54] DEVICE FOR REMOVING THE DEVELOPER MIX FROM A DEVELOPING STATION

[75] Inventors: Walter Kopp, Taufkirchen; Karl-Heinz Saalmueller, Munich, both of Fed. Rep. of Germany

[73] Assignee: Siemens Aktiengesellschaft, Berlin & Munich, Fed. Rep. of Germany

[21] Appl. No.: 369,897

[22] Filed: Apr. 19, 1982

[30] Foreign Application Priority Data

Apr. 30, 1981 [DE] Fed. Rep. of Germany ..... 3117229

[51] Int. Cl.[3] ..... G03G 15/08

[52] U.S. Cl. ..... 355/3 DD; 355/15

[58] Field of Search ..... 355/3 R, 3 DD, 15; 354/324, 331, 333, 335, 336

[56] References Cited

U.S. PATENT DOCUMENTS

| | | | |
|---|---|---|---|
| 3,333,566 | 8/1967 | Kent | 355/3 DD X |
| 3,655,373 | 4/1972 | Fisher et al. | 355/15 X |
| 3,764,208 | 10/1973 | Takahashi et al. | 355/3 R |
| 3.784.297 | 1/1974 | Ito et al. | 355/3 |
| 3,883,240 | 5/1975 | Ito et al. | 355/3 DD |
| 3,912,388 | 10/1975 | Takahashi et al. | 355/3 DD |
| 4,101,211 | 7/1978 | Kayson | 355/3 DD |
| 4,140,388 | 2/1979 | Ikesue | 355/15 |
| 4,267,245 | 5/1981 | Wada | 355/3 DD X |
| 4,274,455 | 6/1981 | Simons | 141/1 |

*Primary Examiner*—Fred L. Braun

*Attorney, Agent, or Firm*—Hill, Van Santen, Steadman & Simpson

[57] ABSTRACT

In a developer station for an electrophotographic printing or copying machine, there is provided a simplified arrangement for the automatic removal of spent or tired developer mix particles in preparation for replenishment with a fresh supply of developer mix. A drain opening is provided at the discharge end of one mixing screw disposed in a mixing chamber portion of the developer station. Flow through this drain opening is prevented during normal developer operation. For removal of the mix particles from the station, flow through the drain opening is unblocked and a pivotable stripper plate is disposed between the magnetic drum and the mixing chamber screw for conducting developer mix spilled off the rotating magnetic drum to the mixing chamber screw, whereupon this screw conducts the mix particles to the discharge opening and out of the developer station.

5 Claims, 2 Drawing Figures

DEVICE FOR REMOVING THE DEVELOPER MIX FROM A DEVELOPING STATION

RELATED APPLICATIONS

This application concerns subject matter which relates to the following commonly assigned U.S. patent applications, all filed Apr. 19, 1982:

Ser. No. 369,832 entitled "Mixing Device for Blending a Developer Consisting of Carrier Particles and Toner,"

Ser. No. 369,833 entitled "Developing Device for Developing Charge Images on a Charge Image Carrier," and Ser. No. 369,834 entitled "Developing Station for Developing Charge Images on a Charge Image Carrier."

BACKGROUND OF THE INVENTION

The invention relates to apparatus for removing developer mix particles from the developer station of a non-mechanical printing or copying machine and, more particularly, to apparatus having means for conducting used developer mix particles from the developer station to a rotary feed screw means from which the developer mix is conducted to an exterior container.

Typically non-mechanical printing or copying machines function according to electrophotographic principles, wherein electrostatic latent images of characters to be printed are generated on a recording medium, such as a photoconductive drum. The drum has on it a semi-conductor layer of photo-electrical or di-electrical material on which electrostatic charge images of the characters to be printed or copied are generated. These electrostatic images are subsequently inked with a toner powder in a developer station. The toner images are subsequently transferred to sheet paper on which they are fixed. The developer station typically includes at least one developer unit generally referred to in the art as a magnetic brush developer. The magnetic brush developer, as a rule, contains a magnetic brush or drum mounted for rotation so as to continually bring developer mix, consisting of iron carrier particles and toner (black powder) particles, into contact with the electrostatic images recorded on the photoconductive drum surface. The charges images are inked by adherence of toner particles to the charge images, due to electrostatic forces. The general principles of developer station construction are known in the art as shown, for example, in U.S. Pat. No. 3,784,297.

During developer operation, the developer mix loses its tribo-electrical properties over the course of time. In order to maintain the quality of printing or copying, old developer mix must be replaced with new developer mix as the former mix nears the end of its usable life. In order to avoid unduly long downtimes during the replacement of developer mix, this replacement process must be easy to carry out.

An object of the present invention is to provide a device for removing developer mix from the developer station in an electrophotographic printing or copying machine in an uncomplicated manner, thus avoiding the use of expensive mechanical structure in the developer station solely for this function.

SUMMARY OF THE INVENTION

In a developer station for an electrophotographic printing or copying machine, there is provided a pair of parallel arranged rotary screws which serve to conduct developer mix particles within the station. The screws are disposed substantially parallel to one another along the bottom floor of the developer station. A first screw is provided adjacent the developer station magnetic brush or drum for conducting the developer mix along the floor of the station for pick-up by the drum. Adjacent the first screw is a second screw disposed within a partially segregated mixing chamber portion of the developer station. This second screw serves to feed new developer mix to the floor of the developer station and also communicates with a sweeping device which conducts used developer mix from the magnetic brush or drum to the second screw for mixing.

At the discharge end of the second screw in the mixing chamber, there is provided a drain opening leading to a downwardly extending open tube. A flexible hose is fitted over the open end of the tube. During instances when the second screw is to conduct developer mix particles into the developer station, the hose is clamped by means pinching off flow through the hose so that particle flow cannot pass through the drain opening and, instead, is conducted from the mixing chamber into the developer station main portion. In order to effect emptying of spent developer mix from the developer station, the magnetic drum is rotated within the station and a ramp or strip is disposed adjacent the drum for conducting developer mix falling off from the drum to the second screw. At the same time, the hose is unclamped and its discharge end is connected to a suitable container, such that developer mix is conducted by the second screw to the drain opening whereupon it passes through the tube and hose into the container for removal from the developer station.

DESCRIPTION OF THE PREFERRED EMBODIMENTS

Figure 1:
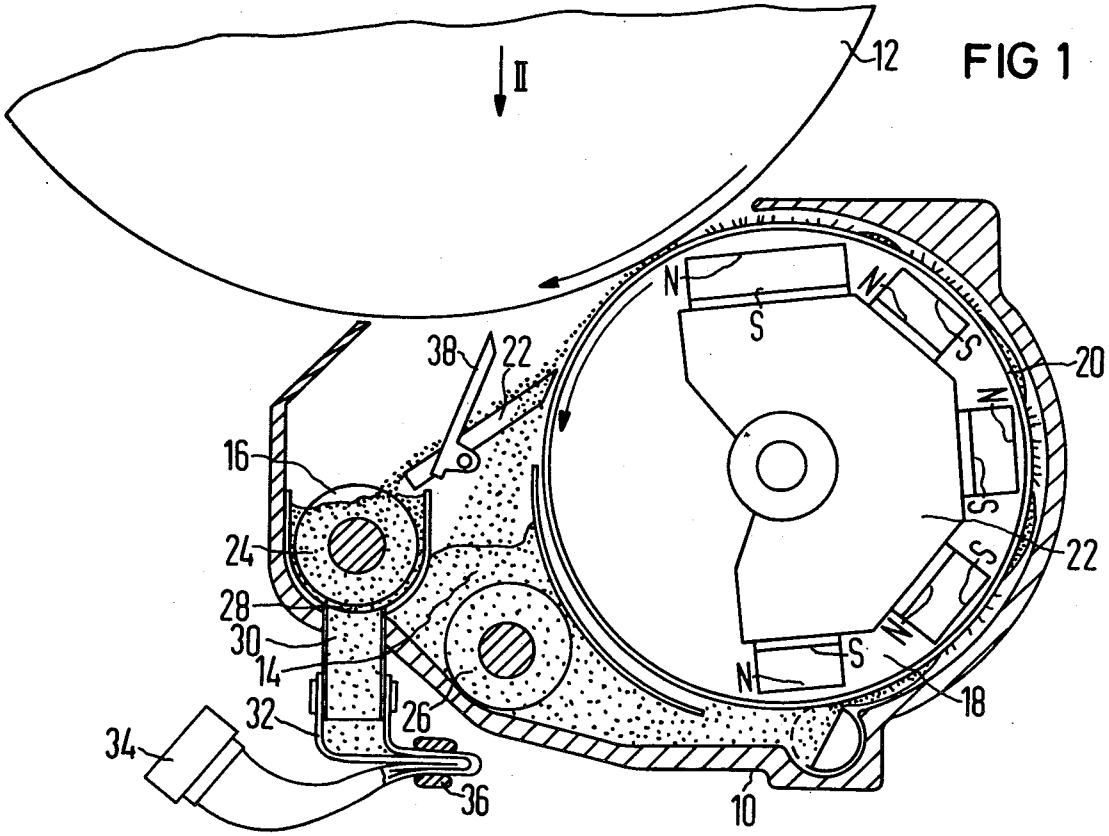
FIG. 1 is a schematic, side elevational cross-sectional view of a developer station having developer mix removal means in accordance with the present invention.

FIG. 1 illustrates a developer station 10 for use in an electrophotographic printing or copying machine. A photoconductive drum 12 is mounted for rotation in the machine in the direction indicated by the arrow for conducting charge images from suitable charging stations (not shown) to the developer station 10 for inking, and then to suitable transfer and cleaning stations (not shown).

The developer station 10 is segregated by a suitable laterally extending wall into a principal chamber 14 and a mixing chamber 16. A magnetic brush or drum 18 is disposed for rotation in the conventional manner within the principal chamber 14. The developer drum 18 comprises a rotating hollow cylinder 20 containing a suitable magnetic arrangement 22. The developer drum 18 serves to conduct developer mix particles, consisting of toner and finely divided iron powder carrier particles, from a main body disposed on the floor of the principal chamber 14 into contact with the charge image surfaces of the photoconductive drum 12. The charge images present on the drum 12 are inked and toner particles along the nip formed between the drums 12 and 18. That portion of the developer mix carried by the magnetic drum 18 which does not adhere to the charge images present on the photoconductive drum 12 spills off under the influence of gravity from the top of the magnetic drum 18 as it passes through the nip. A portion of the spilled back developer mix falls directly into the principal chamber 14 and the remaining portion of the spilled back mix is conducted into the mixing chamber 16 along a downwardly angled stripping plate or ramp 22 disposed between the upper end of the magnetic drum 18 and the adjacent side wall of the mixing chamber 16.

A first mixing screw 26 is disposed for rotation around a lateral axis within the principal chamber 14. This screw means 26 serves to mix the main body of developer particles and cause movement of the developer mix into engagement with the magnetic drum 18.

A second mixing screw 24 is disposed for rotation in the mixing chamber 16 about a lateral axis parallel to the axis of the first mixing screw 26.

Figure 2:
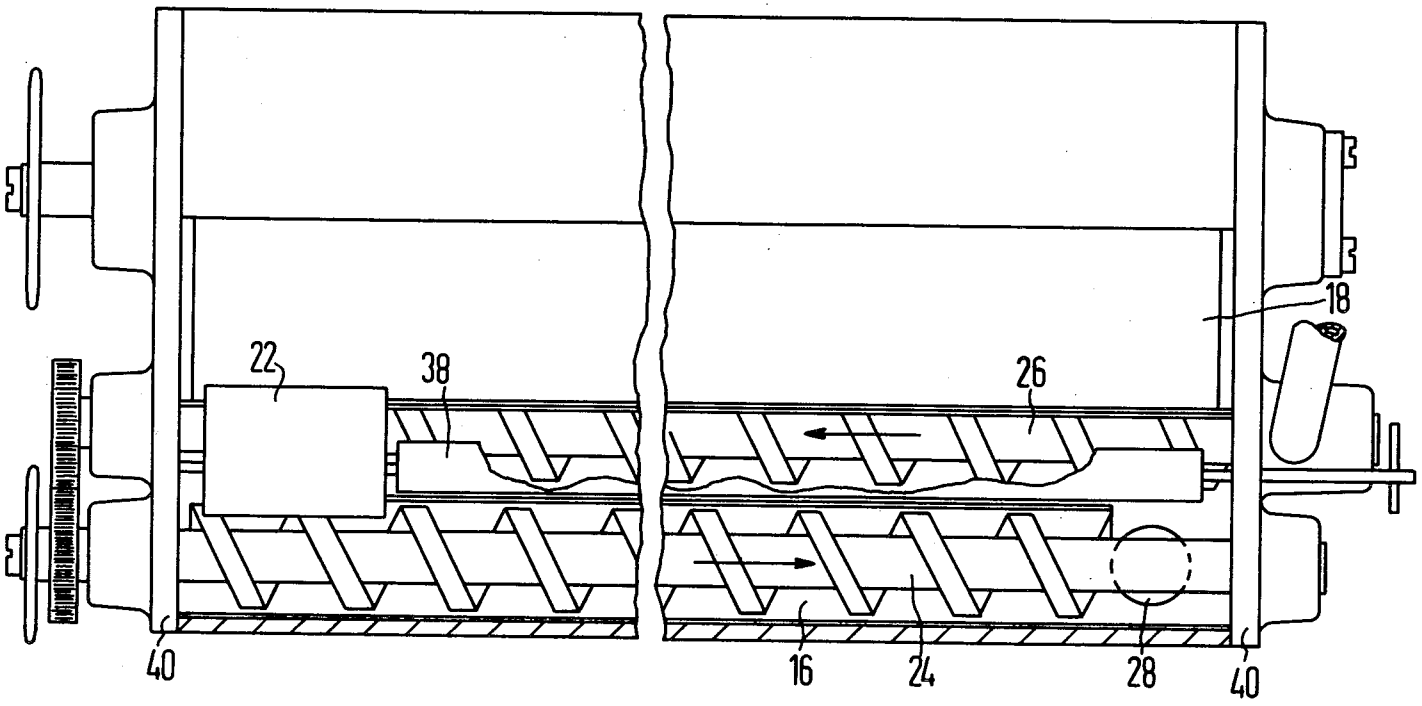
FIG. 2 is a partial plan view of the developer station of FIG. 1 in the direction II of FIG. 1.

With reference to FIG. 2, the developer mix stripped from the developer drum 18 by means of the scraping plate 22 is applied to one end of the mixing screw 24, whereupon it is conducted, as well as being intimately mixed, in the direction of the arrow and, subsequently, discharged passed this lateral side wall of the mixing chamber 16 for re-supply into the principal chamber 14. As shown in FIG. 2, once the mix is again deposited in the principal chamber 14, it is mixed by the first screw 26 and conducted along the floor of the developer station in a transport direction opposite to that of the direction of conveying of the second screw 24. The screws 24 and 26 serve to maintain a random mixture of the developer particles within the developer station in order to maintain a more even inking quality. As well as returning a portion of the used developer mix via the stripping plate 22 into random mixture with the main body of developer particles, the screw 24 may also serve to supply new developer mix particles to the principal chamber 14 as the result of controlled communication with a suitable developer mix supply means (not shown).

A drain opening 28 is disposed in the floor of the developer station 10 at the discharge end of the mixing chamber 16. The drain opening 28 is connected to a downwardly extending open tube 30, the open end of which is fitted with a flexible hose 32. The hose 32 has a free end opening formed with a fitting member 34, which may be formed with annular interior threads for screwing onto a suitable container, such as a screw bottle mouth, to be used for collecting spent developer mix in a manner further described below. During periods when used developer mix is intended to be conducted via the stripping plate or ramp 22 along the rotary screw 24 and back into the principal chamber 14, the flexible hose 32 can be pinched off with the assistance of clamp elements 36 such that a downward flow of mix particles through the tube 30 is effectively blocked and the particles must, instead, pass from the mixing chamber 16 into the principal chamber 14. This period would be the typical operational time of the development process in the station 10, as shown in FIG. 1. During this time, developer mix is not intended to be removed from the developer station 10 and the hose 32 is clasped to prevent flow communication therethrough.

There is provided in the developer station a further, relatively elongated, strip plate 38 adjacent the stripping ramp 22 and disposed for pivotable rotation about a laterally extending axis parallel to the axis of rotation of the screw 24. The strip plate 38 is disposed between the upper end of the developer drum 18 and the adjacent side wall of the mixing chamber 16. In its non-functioning position, as shown in FIG. 1, the plate 38 is disposed in a substantially upstanding position within the developer station 10. In its operating position, the plate 38 is rotated so as to be substantially planar with the stripping plate 22 to form a transfer means whereby substantially all of the developer mix particles spilled from the developer drum 18 are conducted past the principal chamber 14 and into the mixing chamber 16 for transport by the second screw 24. In this operating position, the ramp 22 and the plate 38 serve to provide a flow surface overlying the principal chamber 14 extending substantially the full lateral length between opposed lateral walls 40 of the developer station housing.

The present invention construction enables developer mix to be removed from the developer station 10 at the end of its useful life. When developer mix is to be removed from the developer station, the plate 38 is rotated into its operating position, preferably disposed with its lead end only a slight distance of, for example, 0.5 mm away from the adjacent circumferential surface of the developer drum 18. During developer mix removal operation, the developer drum 18, the charge image carrier drum 12, and the mixing screw 24 rotate simultaneously. The developer mix is conveyed by the developer drum 18 past the inking nip, whereupon the developer mix particles stripped from the developer drum for passage downwardly over the ramp 22 and the strip plate 38 into the mixing chamber 16. The mixing screw 24 conveys the developer mix to the drain opening 28. The clamp means 36 has been removed from engagement with the flexible hose 32, such that the developer mix discharged from the screw 24 is free to pass into the opening 28 and downwardly through the tube 30 and hose 32 to the receiving container connected at the fitting 34 of the hose. This process continues until substantially all of the delapidated developer mix has been conducted out of the developer station 10.

The present invention construction enables developer mix to be quickly removed from a developer station in an automatic manner without requiring extensive or complicated machinery. The strip plate 38 serves to accelerate the developer mix removal operation by by-passing a greater than normal amount of spilled off developer mix particles to the mixing chamber screw 24. Removal of the developer mix from the developer station 10 occurs by virtue of the drain opening 28 disposed in the floor of the station 10 which leads to the tube 30.

While various changes and modifications might be proposed by those skilled in the art, it will be understood that we wish to include within the claims of the patent warranted hereon all such changes and modifications as reasonably come within our contribution to the art.

We claim as our invention:

1. In a developer station having a housing divided into a principal chamber, containing a supply of particle developer mix, at least one rotatable developer drum for conducting developer mix into contact with a charge image carrier surface, and a first rotary screw conveying means for moving developer mix passed into said principal chamber into engagement with said at least one developer drum, and a mixing chamber, containing a second rotary screw conveying means for transporting developer mix therealong to a discharge end passage leading from said mixing chamber to said principal chamber, apparatus for removing developer mix from said station comprising:

a drain opening formed in the floor of said housing adjacent said discharge end passage, a discharge passage means communicating with said drain opening controllable to block or unblock flow therethrough, and a transfer means comprising a plate member pivotably mounted in said housing adjacent said principal chamber movable between a first upraised position allowing developer mix to spill off said developer drum directly back into said principal chamber and a second lowered position for passing developer mix spilled off said developer drum directly into said mixing chamber for transport by said second screw conveying means to said drain opening, said plate member having a lead edge for facing said developer drum, but which is spaced from the circumference of said developer drum in said second lowered position of said plate member, whereby said discharge passage means is unblocked and said developer drum and second screw conveying means are rotated to remove developer mix from said station.

2. The apparatus of claim 1, wherein said discharge passage means comprises a stationary tube connected at one end to said discharge opening and having an opposed open end, a flexible hose fitted at one end onto said tube opening end, and clamp means for selectively pinching off said hose to prevent flow therethrough.

3. The apparatus of claim 2, wherein said hose has an opposed open end provided with a releasable fitting means for connection to a container mouth.

4. The apparatus of claim 1, wherein said plate member lead edge is disposed about 0.5 mm from the circumference of said developer drum in its said second lowered position.

5. The apparatus of claim 1, wherein said transfer means further comprises a stationary ramp means for passing a portion of developer mix spilled off said developer drum into said mixing chamber.

* * * * *